US007003896B2

(12) United States Patent
Tafel

(10) Patent No.: US 7,003,896 B2
(45) Date of Patent: Feb. 28, 2006

(54) RADIATION CURING AND DRYING

(76) Inventor: Leonard Immanuel Tafel, 1821 Azalea La., Mt. Prospect, IL (US) 60056

( * ) Notice: Subject to any disclaimer, the term of this patent is extended or adjusted under 35 U.S.C. 154(b) by 95 days.

(21) Appl. No.: 10/693,054

(22) Filed: Oct. 25, 2003

(65) Prior Publication Data

US 2004/0139623 A1 Jul. 22, 2004

Related U.S. Application Data

(60) Provisional application No. 60/421,337, filed on Oct. 25, 2002.

(51) Int. Cl.
*F26B 3/34* (2006.01)

(52) U.S. Cl. ..... 34/275; 34/618; 34/643; 101/351.1

(58) Field of Classification Search ..... 34/275, 34/618, 643, 651; 101/351.1, 185; 250/325
See application file for complete search history.

(56) References Cited

U.S. PATENT DOCUMENTS 2,427,892 A * 9/1947 Adams ..... 34/647
2,922,883 A * 1/1960 Giaimo, Jr. ..... 250/326
3,691,375 A * 9/1972 Gawron et al. ..... 250/325

OTHER PUBLICATIONS

Honeywell Environizer Safety Instructions dated 2002.*

* cited by examiner

*Primary Examiner*—Stephen Gravini

(57) ABSTRACT

An improved apparatus and method for drying materials. A hot surface in a strong electrostatic field is used to ionize a stream of heated gasses passing over the surface, which assists in directing the stream against the object to be dried, and ionizes the vapors and gasses emitted from surface of the material being dried, which assists in their separation and removal.

9 Claims, 2 Drawing Sheets

RADIATION CURING AND DRYING

This application claims the benefit of Provisional Application No. 60/421,337, filed Oct. 25, 2002.

BACKGROUND OF THE INVENTION

The present invention relates generally to the drying and setting of materials, and more particularly, but not limited to, the drying ink and paint coatings.

A variety of industrial, commercial and consumer goods require a solidification process, either removal of liquids contained in the structure of the goods, or a coating applied thereon, or by catalysis of the goods themselves or their coatings. Some materials require a curing process that may is usually initiated by the addition of some form of energy. In the case of many inks and coatings, the removal of some or all of the liquid portion to initiate solidification releases a large perfusion of fumes and vapors, many having known health risks. Commonly, a large volume of high-velocity heated air is directed at the surface, even though only a fraction of the air actually comes even near the surface, due to the difficulty in penetrating through the "boundary layer effect" of vapors and gasses near the surface. The counter-current of fumes and vapors clinging to the surface also create a barrier against convective heating as well as preventing radiation from reaching the surface of the material to be dried.

Electrostatic precipitators generally will not remove gasses, so an odor would remain. Large high-pressure fans are required to even partially penetrate the boundary layer near the surface of the material, and once the blast of hot air, fume and vapors has left the surface it is not usually reused, but is "cleaned up" and exhausted into the atmosphere. Due to the huge volumes of air contaminated with vapors and fumes produced by this process, removal of the contaminants through incineration or high-temperature catalysis is expensive and wasteful, often doubling the energy expenditure of the initial drying operation. Water based coating drying systems, while not requiring as much "clean-up" of the effluent, still require substantial amounts of energy and process time due to the high latent h at of vaporization of water, thus slowing production rates.

SUMMARY OF THE INVENTION

The present invention discloses a drying system comprising: a blower that passes air over flames electrically charged to a high-voltage source, ionizing rods containing rows of pins, some of which are connected to ground and some to a high-voltage DC supply, and insulated strands of wire in the effluent stream for collecting the ionized fumes and solvents.

DETAILED DESCRIPTION OF THE PREFERRED EMBODIMENT

Figure 1:
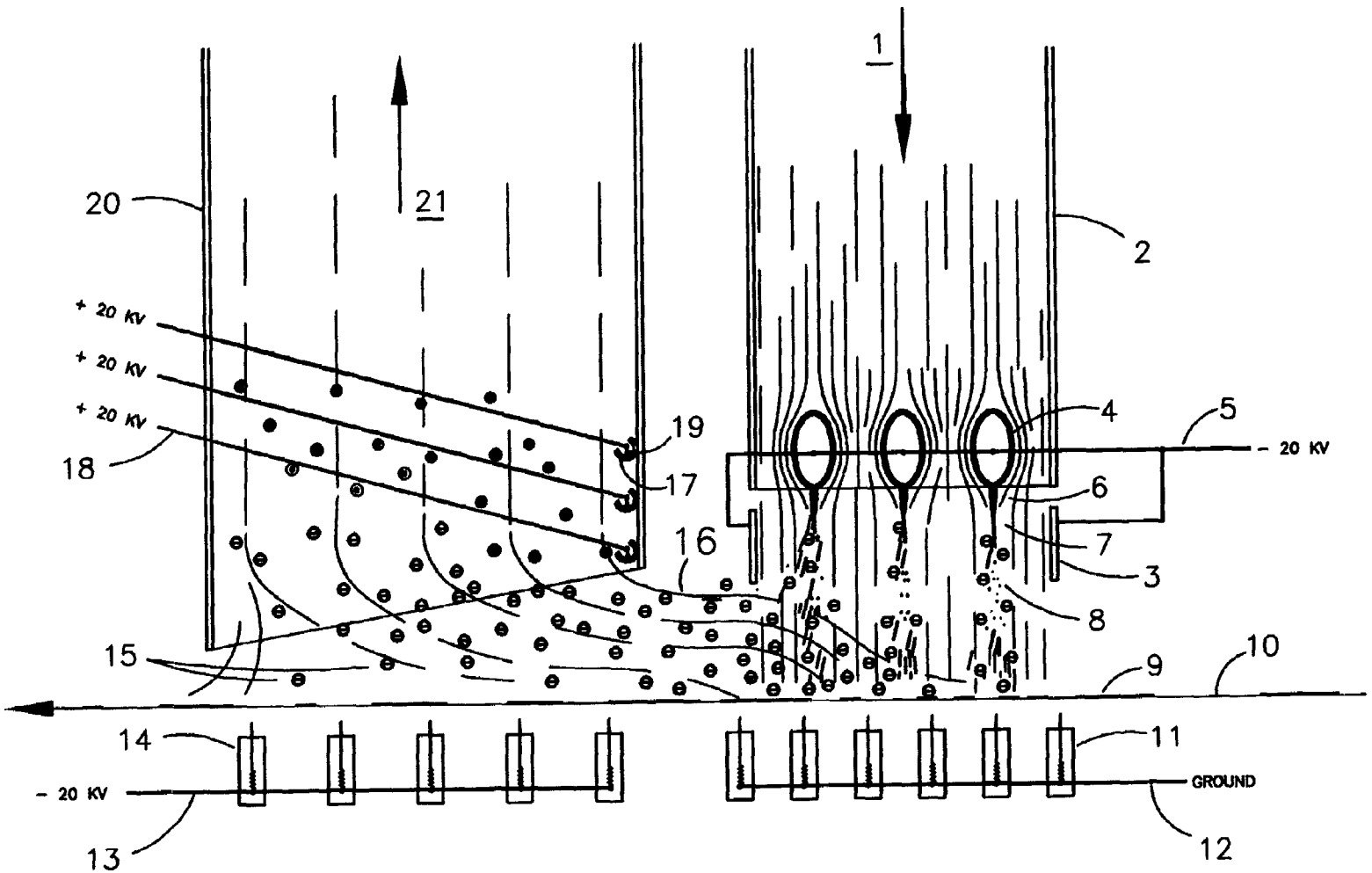
FIG. 1 shows a semi diagrammatic view of the system for drying one side of a continuous web using the concepts of this invention.

Referring now specifically to the drawings, FIG. 1 shows diagrammatically a drying system in accordance with the present invention. The purpose of the illustrated system is to rapidly dry and cure printing inks or coatings applied upstream on the web by a printing press or coater of common design and construction which is located upstream (not shown). Although the illustrations depict a paper web with uncured or wet printing ink applied thereto, the present method and apparatus will be understood to apply to objects of various shapes and compositions. These objects may themselves be solidified, dried of cured, or they may have a surface or internal coating to be altered. Inks, coatings, films and plastics may be formulated which are particularly susceptible to being selectively altered by the ultraviolet radiation and ozone produced by this system.

As illustrated in FIG. 1, the web enters from the right and passes under the outlet from duct 2 that encloses preheated air 1 descending past heated tubes 4 that are maintained at a high voltage negative potential by wire 5 connected from DC power supply to said tubes thereby causing an electrostatic field 8 between the flames 7 in serrated channel 6 to the web 10 and the ink image 9 applied thereto, and thence to charge bars 11 connected to the power supply ground by wire 12.

These heated tubes are referred to hereinafter as "charge tubes" and may or may not have flames emitting therefrom. "Charge bars" are elongated, insulated structures have exposed conductive surfaces from which an electrostatic charge emanates, usually in the form of a row of oxidation-resistant pins usually internally electrically interconnected. There are commercially available variations, some having the individual pins connected to a common bus by resistors, which serves to even out the electrostatic field and reduce arcing. They are usually constructed of an insulating material, and have an internal electrical connection from the conducting surfaces to a connection plug or terminal.

The flow of electrical current through said electrostatic field and web to the charge bars 11 creates additional heating added to the convective heat from the airstream 1, and said heating impinging on the web and the ink applied thereon, causes vaporization and oxidizing of some of the ink components. With sufficiently high voltage, a corona may be caused to occur on the surfaces being treated, which may solidify certain inks. Ozone may also be produced which may rapidly oxidize certain inks and coatings. The gasses vapors and fumes 16 emanating from said web and ink into the electrostatic field acquire a charge. Convective movement away from the web by said ionized gasses, fumes and vapors 16 is assisted by said acquisition of a negative charge 15, said charge causing them to be repelled from the surface of the web that now passes over negatively charged bars 14. Said ionized gasses, fumes and vapors move into up into duct 20 by a combination of suction airstream 21 and repulsion from a negative charge on the plurality of charge bars 14, said bars being connected to the power supply by wire 13. Said ionized gasses, vapors and fumes 16 are attracted to wires 18 that are at a positive high-voltage potential, said vapors and fumes adhering to said wires in the form of liquid and solids 19 that runs down said wires into receptacles 17 for removal and recycling. Special inks may be formulated that are particularly sensitive to exposure to electrons in the electrostatic field, said inks adhering to said web undergoing a reaction so disposed as to cause curing and solidification. Removal of the fumes and vapors attracted to wires 18 may be facilitated by wires that are formed into an endless belt, whereby said wires may be continuously cleaned by moving past a cleaning means such as a brush or scraper.

Although drying of only one side of a web is depicted, it is understood that by inverting or re-orienting the structures of the present invention, drying or curing my be effected on opposing sides of any object, the top and bottom of a web printed or coated on both sides in this instance.

Figure 2:
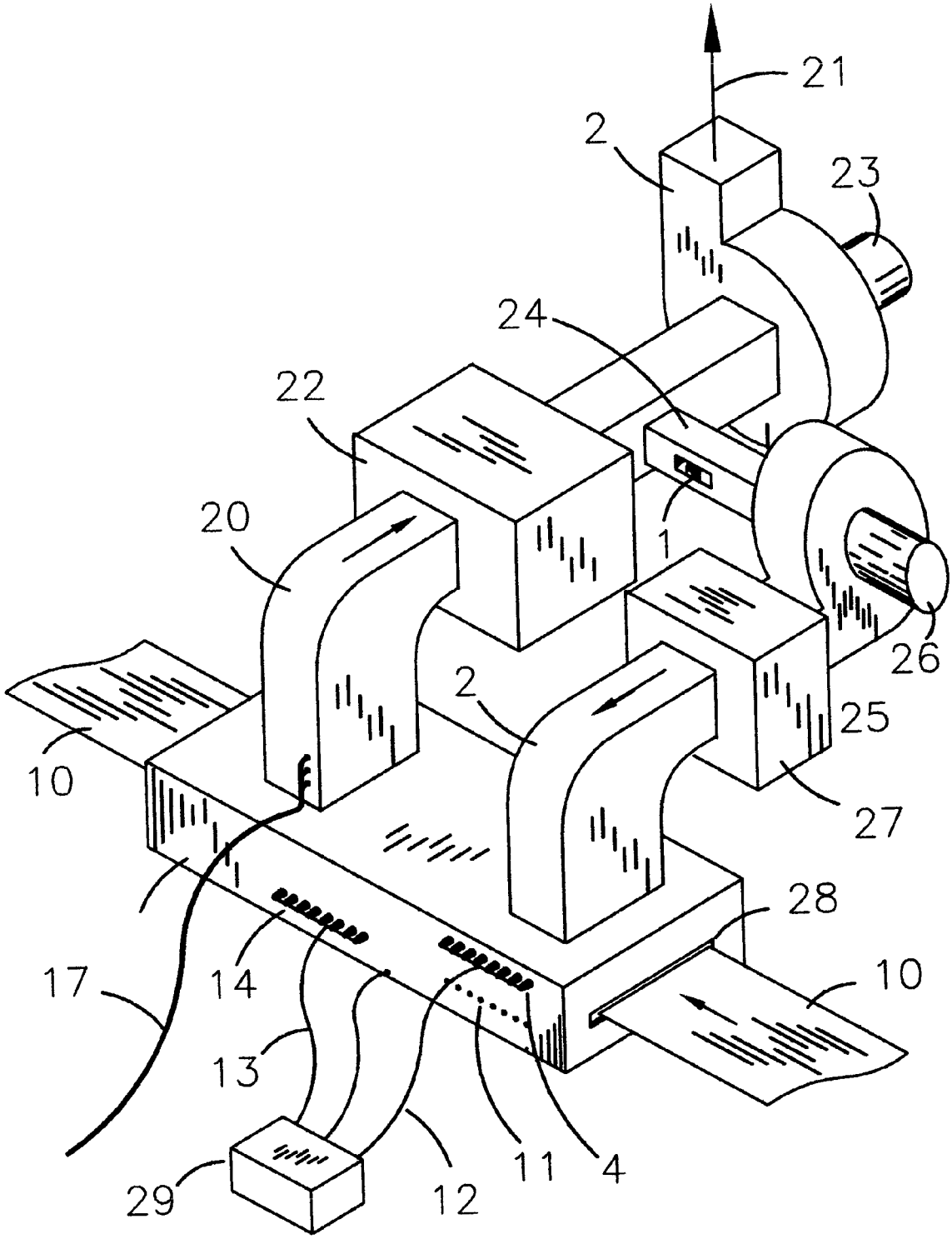
FIG. 2 shows a pictorial view of the invention showing an overall external view.

FIG. 2 shows the present invention in an overall view of the preferred embodiment for drying or curing the top of a web. Blower 25 driven by motor 26 draws environmental air into adjustable aperture 1 and expels said air through preheater 27, into duct 2 where it moves across ionizing bars 4 and impinges against the top of web 10 which enters housing 7 through elongated aperture 28. High-voltage supply 29 is connected by ground wire 12 to the housing. Insulated negative high-voltage wires 5 and 13 connect to the ionizing bars 4 and 14 respectively. Collector wires 18 (shown in FIG. 1) are connected to the positive high-voltage terminal of said power supply by insulated wire 24. Liquid captured from the airstream 21 is conveyed by drain tube 30 into an appropriate container. Remaining contaminants in the airstream 21 are removed by conventional filtering means 22. A portion of the air exiting from said filtering means is recycled into the inlet of blower 26 by duct 23.

What is claimed is:

1. A system for solidifying ink printed on a moving web of paper comprising:

a structure means for directing an airflow across a plurality of elongated and perforated hollow tubes at a high negative electrical potential, said tubes also containing flammable gas under pressure, so disposed as to emit flames along the length of said tubes, said tubes thereby becoming sufficiently heated so as to initiate thermionic-emission of ions from said tubes into said airstream, and charge bars so disposed that said web is interposed between said charge bars and said tubes, the ionized airstream being thereby attracted to the web interposed in the electrostatic field created between said tubes and said charge-bars, thereby causing ionization of gasses, vapors and fumes as they are emitted from said web, and means for collecting said ionized gasses, fumes and vapors.

2. The system in claim 1 wherein the voltage on the charge tubes is sufficient to cause a corona on the surface of the web, the ultraviolet energy causing the inks and coatings to become solidified.

3. The system in claim 1 wherein the voltage on the charge tubes is sufficient to create an ozone atmosphere at the surface of the web, thereby causing the inks and coatings to become solidified.

4. A system for solidifying ink printed on a moving web of paper comprising:

a structure means for directing an airflow across a plurality of elongated tubes, said elongated tubes being maintained at a sufficiently high temperature and electrical positive voltage potential to cause a stream of ions to be released from said tubes and said flames, thereby ionizing said airstream wherein said elongated tubes contain a mixture of fuel and air and being so disposed as to support flames along their length, and said flames being spaced from the web being treated , and charge bars so disposed that said web is interposed between said charge bars and said elongated tubes, whereby an electrostatic field is created causing ionization of said vapors gasses and fumes as they are repelled from said web.

5. A system for solidifying a coating on a moving web comprising: blower and duct structures for directing an airflow across a plurality of heated high-voltage structures so disposed as to provide thermionic emission, the heated and ionized airflow then being attracted towards a plurality of elongated charge bars, said moving web being interposed between said heated high-voltage structures and said charge bars and said ionized airstream being thereby attracted to the web interposed in the electrostatic field created between said wires and said charge-bars, thereby causing ionization of the emitted effluent consisting of condensing vapors, fumes and nascent gasses as they leave said web, said web then moving into a second position wherein said emitted effluent is repelled from the web by a second charge bar and attracted to a collection structure.

6. The system in claim 5 wherein said coating is ink on the surface of a moving web of paper.

7. The system in claim 5 wherein said heated high-voltage structures are perforated hollow tubes containing flammable gas under pressure.

8. The system in claim 5 wherein said heated high-voltage structures are coated with material that facilitates thermionic-emission, alkaline earth oxides being exemplary of said materials.

9. The system in claim 5 wherein said collection structure consists of a cooled, moving endless band, said band being continuously cleaned for collection of said emitted effluent adhered thereto.

* * * * *